US009056219B2

(12) United States Patent
Hess, II

(10) Patent No.: US 9,056,219 B2
(45) Date of Patent: Jun. 16, 2015

(54) VOLUMETRIC WEIGHT SYSTEM FOR ENHANCING FITNESS

(71) Applicant: Michael Brent Hess, II, Alexandria, VA (US)

(72) Inventor: Michael Brent Hess, II, Alexandria, VA (US)

( * ) Notice: Subject to any disclaimer, the term of this patent is extended or adjusted under 35 U.S.C. 154(b) by 285 days.

(21) Appl. No.: 13/834,876

(22) Filed: Mar. 15, 2013

(65) Prior Publication Data

US 2014/0005011 A1 Jan. 2, 2014

Related U.S. Application Data

(60) Provisional application No. 61/666,965, filed on Jul. 2, 2012.

(51) Int. Cl.

| | |
|---|---|
| ***A63B 21/00*** | (2006.01) |
| ***A63B 21/06*** | (2006.01) |
| ***A61H 3/04*** | (2006.01) |
| ***A63B 15/00*** | (2006.01) |
| ***A63B 23/035*** | (2006.01) |
| *A63B 71/00* | (2006.01) |

(52) U.S. Cl.

CPC *A63B 21/06* (2013.01); *A61H 3/04* (2013.01); *A63B 15/00* (2013.01); *A63B 21/0004* (2013.01); *A63B 21/0608* (2013.01); *A63B 21/143* (2013.01); *A63B 21/1469* (2013.01); *A63B 23/0355* (2013.01); *A63B 2071/0072* (2013.01); *A63B 2210/50* (2013.01); *A63B 21/00065* (2013.01); *A63B 21/00061* (2013.01)

(58) Field of Classification Search

USPC ..... 482/93, 91, 110

See application file for complete search history.

(56) References Cited

U.S. PATENT DOCUMENTS

| | | | | |
|---|---|---|---|---|
| 3,342,482 | A * | 9/1967 | Paolone | 482/110 |
| 3,402,325 | A * | 9/1968 | Minks | 361/56 |
| 4,092,799 | A * | 6/1978 | Anderson | 446/247 |
| 6,488,614 | B1 * | 12/2002 | Chang | 482/110 |
| 2014/0342882 | A1 * | 11/2014 | Huang et al. | 482/110 |

* cited by examiner

*Primary Examiner* — Jerome w Donnelly

(57) ABSTRACT

A volumetric weight system with an elongated handle is provided as a fitness tool used in performing a plurality of exercise routines unique to the volumetric weight system. The present invention accomplishes this through the use of an elongated handle centrally attached to a spherically shaped volumetric weight. The elongated handle provides the present invention with a manipulable surface that enables the user to vary the intensity of their work out by repositioning their hands relative to the volumetric weight. The volumetric weight is centrally attached to elongated handle providing balance while performing a plurality of exercises. The volumetric weight system utilizes an interchangeable engagement for the purposes of switching between weighted components during a workout without complicated disassembly steps. Additionally, the present invention is provided with secondary weights that are attach to the volumetric weight in order to slight vary the resistance of an exercise routines.

17 Claims, 13 Drawing Sheets

VOLUMETRIC WEIGHT SYSTEM FOR ENHANCING FITNESS

The current application claims a priority to the U.S. Provisional Patent application Ser. No. 61/666,965 filed on Jul. 2, 2012.

FIELD OF THE INVENTION

The present invention relates generally to a fitness system. More particularly, the present invention relates to a fitness system that utilizes a volumetric weight that is attached to an elongated handle.

BACKGROUND OF THE INVENTION

It is a well known fact that people generally tend to adapt to whatever situation they are currently in, both mentally and physically. Whatever situation a person is continuously exposed to, the tendency is that over time the person will manifest new traits or modifications of old traits that reflect a reaction to the situation, generally a reaction that enables the person to better survive, accomplish a task or otherwise be better suited to handle the situation. This adaptation is an essential trait for the survival and general progress of any species.

A common example of adaptation to one's environment in action is exercise. If a person's long-term environment and situation are one in which they do not perform physical activity, the person's muscles will end up being weaker than a person who exercises regularly because the person's long-term environment does not require a reliable source of physical strength, leading to the deterioration of the muscle tissue since it is not used often and therefore not needed. In other words, a person must "use it or lose it." This effect is not limited to physical exercise; solving puzzles and otherwise "exercising" one's brain will lead to better mental performance, while consistently deferring to exert mental effort will lead to a drop in mental performance.

Physical exercise is a bodily activity that enhances or maintains physical fitness and overall health and wellness. It is performed for various reasons including strengthening muscles and the cardiovascular system, honing athletic skills, weight loss or maintenance, and personal enjoyment and satisfaction. Physical exercise is arguably one of the most effective ways to maintain a healthy body as well as a healthy mind, with health care providers often referring to exercise as a "miracle drug," with benefits including maintaining a healthy weight, building and maintaining healthy bone density, muscle strength and joint mobility, promoting overall physiological well-being, reducing surgical risks, and strengthening the immune system. Exercise also has been shown to improve cognitive functioning and sleep as well as helping relieve depression.

Types of physical exercise include flexibility exercises, aerobic exercises, and anaerobic exercises. Aerobic exercises focus on improving cardiovascular endurance and include exercises such as running, walking, swimming, jumping rope, rowing, and cycling. Anaerobic exercises such as weight training, functional training, sprinting and high-intensity interval training focus on increasing short-term muscle strength.

Many methods of exercise require equipment to carry out effectively, which more often than not takes the form of weighted objects such as barbells and dumbbells. Other equipment such as weight exercise machines may be used, in addition to treadmills, elliptical machines, stair climbing machines and rowing machines. In general, one may wish to incorporate a wide variety of exercises in order to achieve a well-rounded physique. Dumbbells are a common item of exercise equipment which, depending on the weight and an individual's strength, may be lifted with one hand and facilitate a wide variety of exercises, making them the instrument of choice for many people due to their versatile nature. The dumbbell's versatility arises from its simplicity, and as long as a person can maintain a firm grip on the handle, they may perform a wide variety of moves. On occasion some people may become accustomed to performing the same moves utilizing the same equipment and get bored with it, or they may wish to diversify or switch up their workout for other reasons. Another factor in using different exercise equipment is changing the weight one is working out with. For dumbbells, this requires selecting a different dumbbell, which means that a person or gym desiring to have a wide variety of weights to work out with, they must purchase a large quantity of dumbbells.

It is therefore an object of the present invention to provide a volumetric weight system with an elongated handle as a fitness tool that is used in performing a plurality of exercise routines unique to the volumetric weight system. The present invention accomplishes this through the use of an elongated handle centrally attached to a spherically shaped volumetric weight. The elongated handle provides the present invention with a maniputable surface that enables the user to vary the intensity of their work out by repositioning their hands relative to the volumetric weight. The volumetric weight is centrally attached to elongated handle providing balance while performing a plurality of exercises. Additionally, the present invention is provided with secondary weights that are attach to the volumetric weight in order to slight vary the resistance of an exercise routines.

BRIEF DESCRIPTIONS OF THE DRAWINGS

DETAIL DESCRIPTIONS OF THE INVENTION

All illustrations of the drawings are for the purpose of describing selected versions of the present invention and are not intended to limit the scope of the present invention.

Figure 1:
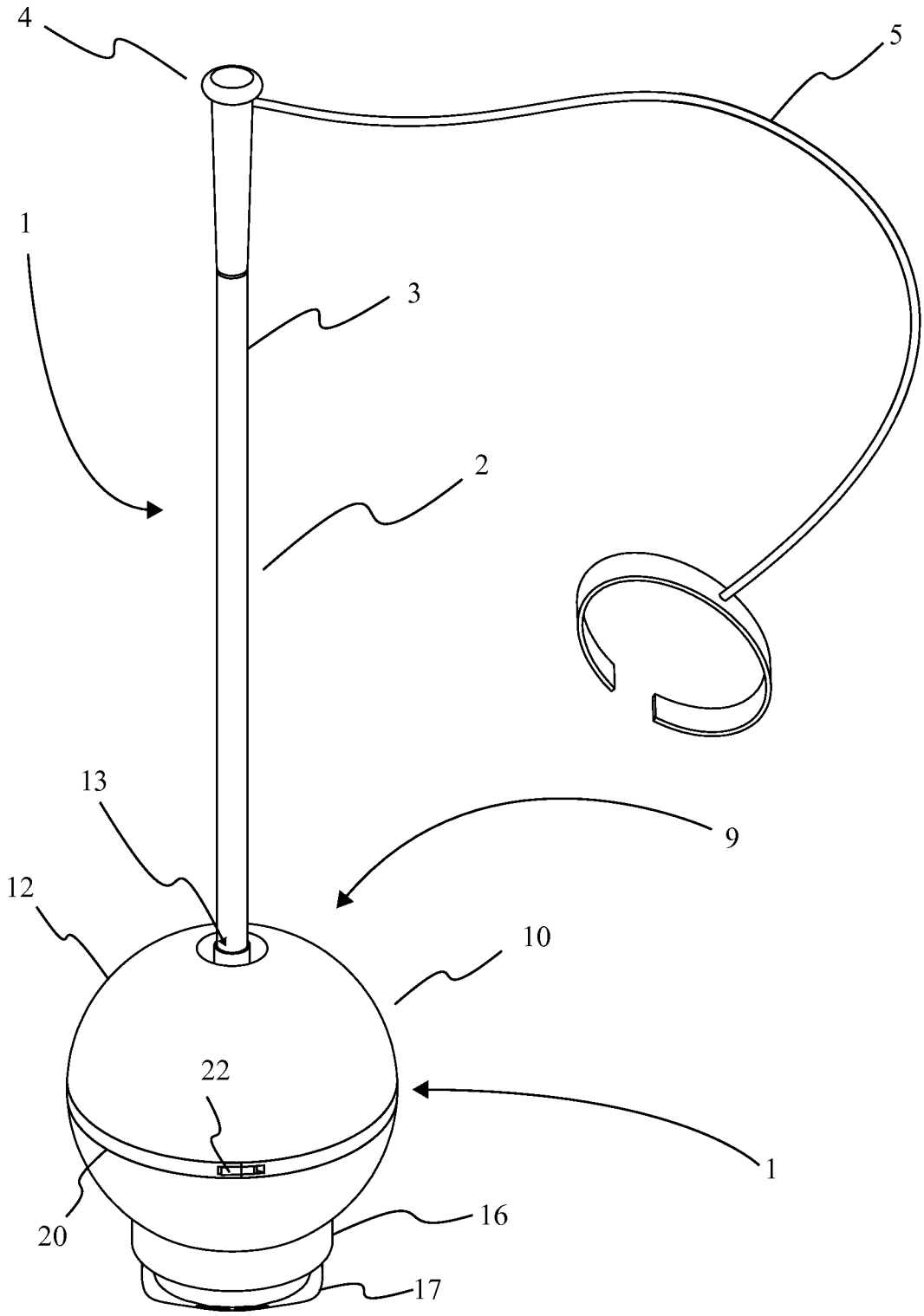
FIG. 1 is a perspective view displaying the component arrangement of the elongated handle, the weight assembly, and the detachable weights, as per the current embodiment of the present invention.
Figure 2:
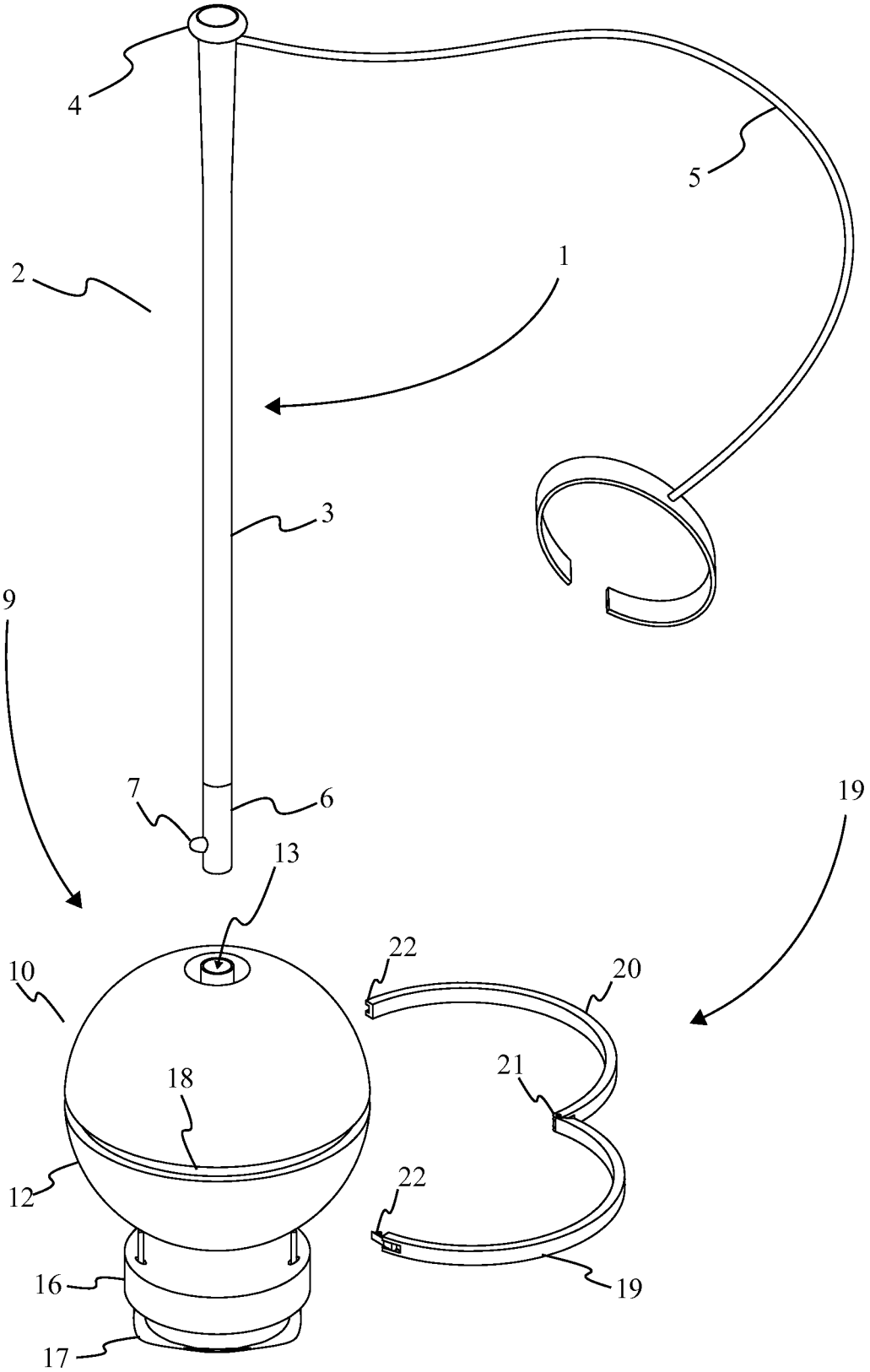
FIG. 2 is an expanded perspective view displaying the component and subcomponent arrangement of the elongated handle, the weight assembly, and the detachable weights as per the current embodiment of the present invention.

Referencing FIG. 1 and FIG. 2, the present invention is a volumetric weight system and a method for utilizing said volumetric weight system for the purposes of exercising. The present invention is designed to provide users with the method to utilize the volumetric weight system in order to perform a plurality of unique workouts. The volumetric weight system carries the advantage of providing users with an integrated attachment system that enables the user to increase or decrease the weight for an exercise through the use of interchangeable assemblies. In the current embodiment of the present invention the volumetric weight system comprises an elongated handle 1, a weight assembly 9, and a detachable weight 19. The elongated handle 1 is provided as an extended rod that couples to the weight assembly 9 as a means of manipulation and as a means of facilitating various unique exercises. The detachable weight 19 is the secondary weight system that provides an additional means of changing the resistance to the weight assembly 9. The weight assembly 9 is the sphere shaped mass that provides resistance during an exercise routine. The elongated handle 1 is aligned centrally with the detachable weight 19. The central alignment provides length of the elongated handle 1 as an axis that traverse the center of the detachable weight 19. The detachable weight 19 is positioned concentric to the weight assembly 9, allowing for the weight assembly 9 to share the collinear arrangement with the elongated handle 1. The elongated handle 1 is positioned normal to the weight assembly 9, wherein the normal positioning provides the elongated handle 1 being perpendicular to the weight assembly 9 when positioned centrally.

Referencing FIG. 1 and FIG. 2, the elongated handle 1 is provided as the means of manipulating the weight assembly 9. The elongated handle 1 utilizes a detachable engagement with the weight assembly 9 that allows the interchangeability between differently sized weight assemblies 9. In the current embodiment of the present invention, the elongated handle 1 comprises a cylindrical body 2, a gripping surface 3, a knob 4, a tethered strap 5, and an assembly coupler 6. The cylindrical body 2 is the provided as the geometric shape of the elongated handle 1 which allows the placement of the gripping surface 3, the knob 4, tethered strap 5, and assembly coupler 6. The gripping surface 3, the knob 4, the tethered strap 5, and the assembly coupler 6 are positioned along the length of the cylindrical body 2. The gripping surface 3 is positioned between the knob 4 and the assembly coupler 6. The gripping surface 3 is provided as the engaging surface between the elongated handle 1 and the user's hand. The gripping surface 3 can be provided with a higher friction coating or ergonomic form factor to facilitate this interaction. The gripping surface 3 partially encases the cylindrical body 2 as higher friction coating. The knob 4 is the terminally positioned obstruction on the cylindrical body 2, that functions in combination with the gripping surface 3 to prevent the loss of grip. The knob 4 may be provided as a formed structure or as an additional component. The tethered strap 5 is a combination safety component and exercise facilitator that prevents the modular exercise system from causing the user or other damage due to accidental loss of grip allowing for exercise routines that do not require direct manipulation by the user. The tethered strap 5 is found coupled to the cylindrical body 2 adjacently positioned to the knob 4. The aforementioned positioning permits the tethered strap 5 to be positioned adjacent to gripping surface 3. The adjacent positioning of the tether strap positions it opposite the assembly coupler 6 relative to the positioning of the gripping surface 3. The assembly coupler 6 is the portion of the elongated handle 1 that detachably engages the weight assembly 9. The assembly coupler 6 is found positioned adjacent to the gripping surface 3 proximal to the positioning of the weight assembly 9.

Figure 3:
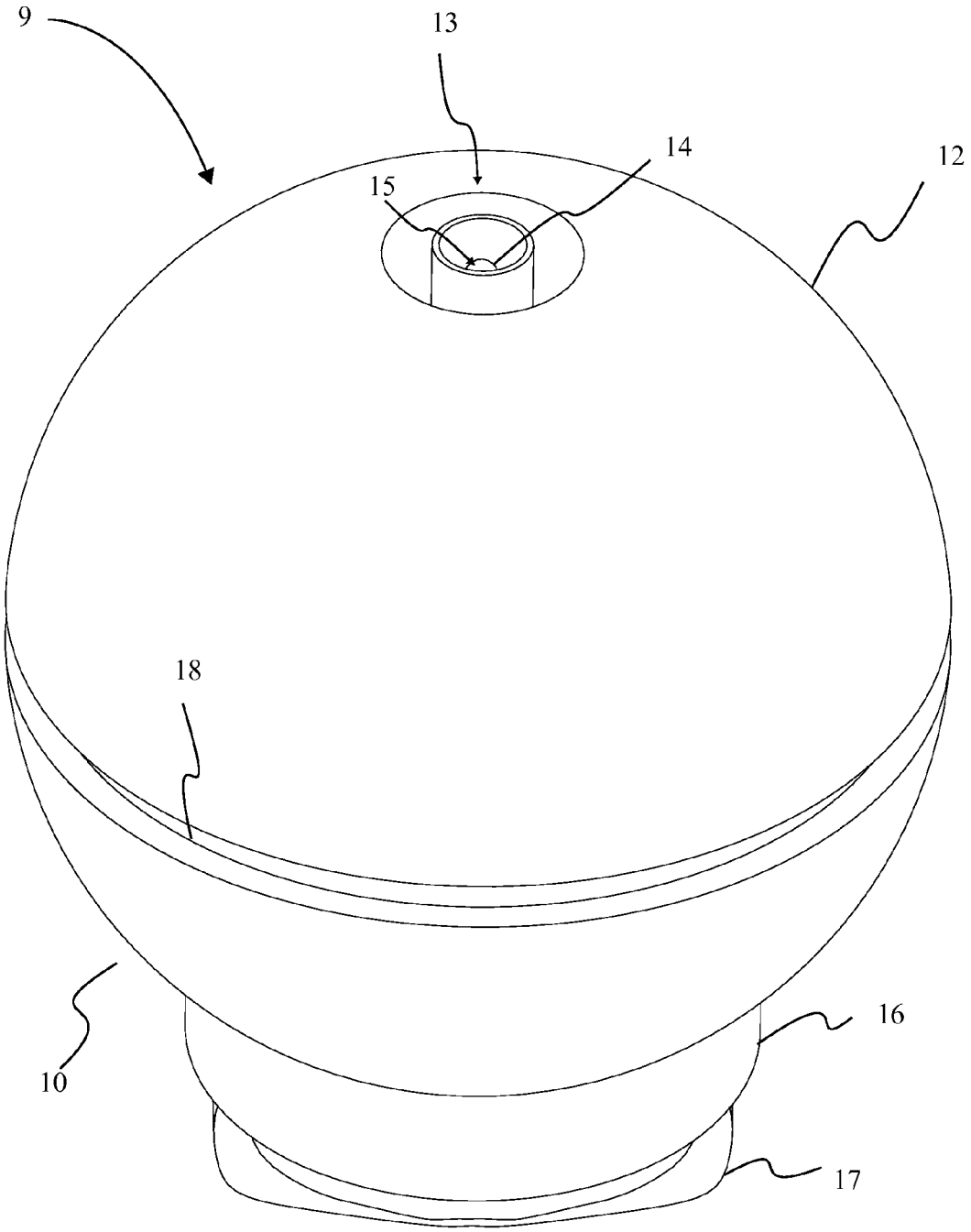
FIG. 3 is an enhanced view of the weight assembly displaying the sub component distribution as per the current embodiment of the present invention.
Figure 5:
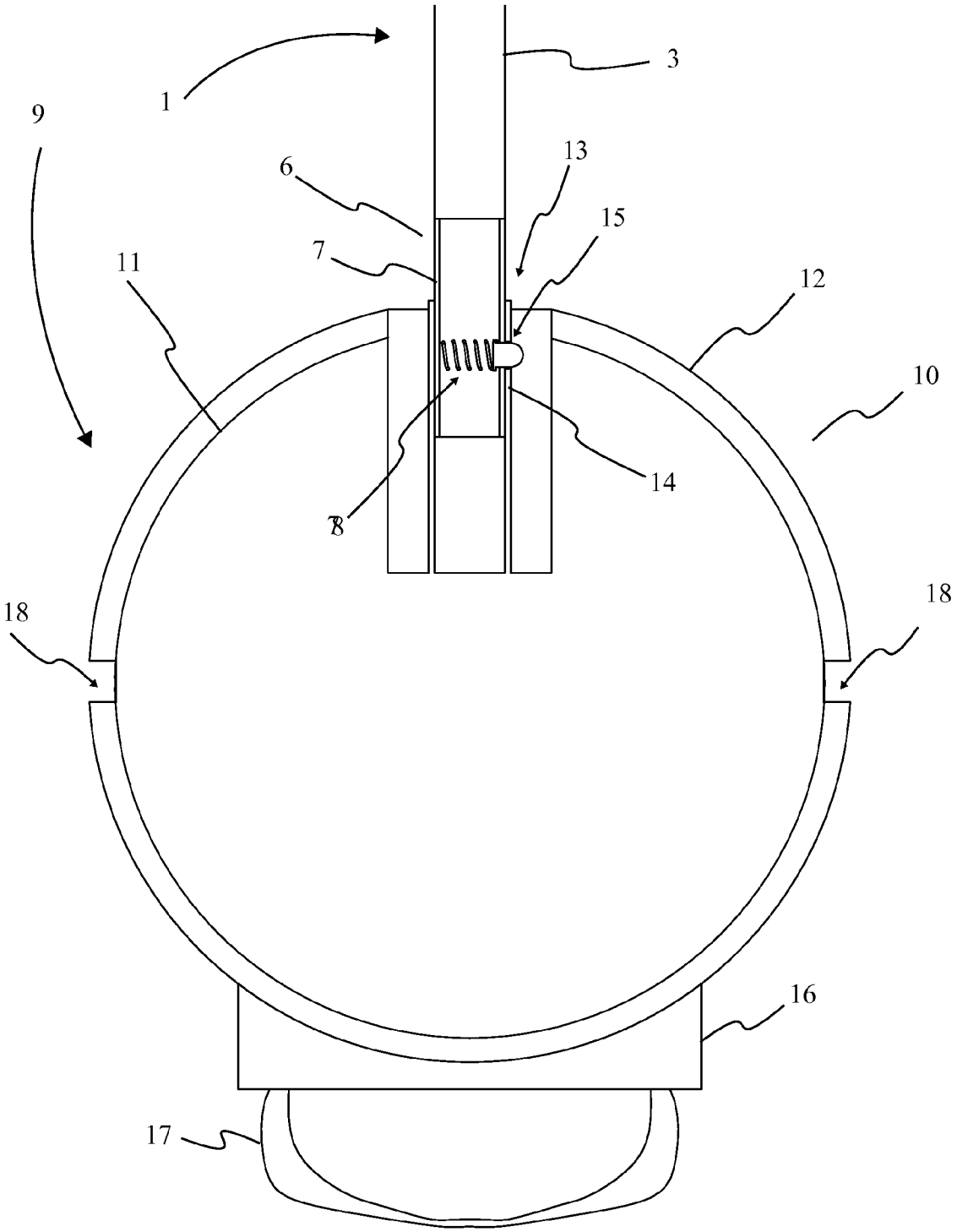
FIG. 5 is a cross sectional view displaying the internal component engagement between the elongated handle and the weight assembly as per the current embodiment of the present invention.

Referencing FIG. 3 and FIG. 5, the weight assembly 9 is provided as the lower half of the present invention that couples to the elongated handle 1 to provide resistance during work out routines. In the current embodiment of the present invention, the weight assembly 9 comprises a spherical body 10, a handle shaft 13, a shaped base 16, and a recessed track 18. The spherical body 10 is the geometric shape of the weight assembly 9 that provides a compact design with a high weight to volume ratio due to the intrinsic properties of the spherical shape. The spherical body 10 is traversed into by the handle shaft 13. The handle shaft 13 is the mounting point between the elongated handle 1 and the weight assembly 9. The shaped base 16 is the lower portion of the weight assembly 9 that allows a stationary positioning for the weight assembly 9 when not in use. The shaped base 16 is provided as a detachable component and is positioned below the spherical body 10. The shaped base 16 is coupled opposite to the positioning of the handle shaft 13 relative to the spherical body 10. The recessed track 18 is the engagement provided as a means of mounting the detachable weight 19 to the weight assembly 9. The recessed tract is found concentrically positioned to the spherical body 10.

Referencing FIG. 5, the spherical body 10 is provided as the geometric shape of the weight assembly 9 but additionally provides secondary features associated with it construction. In the current embodiment of the present invention, spherical body 10 comprises a weighted body 11 and a padded exterior 12. The weighted body 11 is the portion of the spherical body 10 that contains a dense material construction that enables the compact form factor. The weighted body 11 is found positioned within the spherical body 10 surrounding the handle shaft 13. The padded exterior 12 is the cushioned exterior portion of the spherical body 10 that functions as a safety component that reduces the chances of injury due to accidental loss of grip. The padded exterior 12 is the most visible portion of the spherical body 10. The padded exterior 12 is perimetrically positioned around the weighted body 11 effectively encasing the harder denser material. The padded exterior 12 is circumferentially traversed by the recessed track 18, wherein the circumferential positioning of the recessed track 18 positions it in a manner that appears to section the padded exterior 12 into an upper section and a lower section. The recessed track 18 is mounted to the weighted body 11 allowing a secure engagement between the detachable weight 19 and the recessed track 18.

Referencing FIG. 3 and FIG. 5, the shaped base 16 is provided as the lower structure that enables the weight assembly 9 to remain stationary when not in use. In the current embodiment of the present invention the shaped base 16 comprises a strap handle 17. The strap handle 17 is a flexible handle mounted to the shaped base 16 that allows the manipulation of the weight assembly 9 without necessitating an engagement with the elongated handle 1. The strap handle 17 can additionally function as secondary engagement point utilized in certain exercise routines. The strap handle 17 is found positioned on the shaped base 16 opposite to the padded exterior 12 of the spherical body 10.

Figure 4:
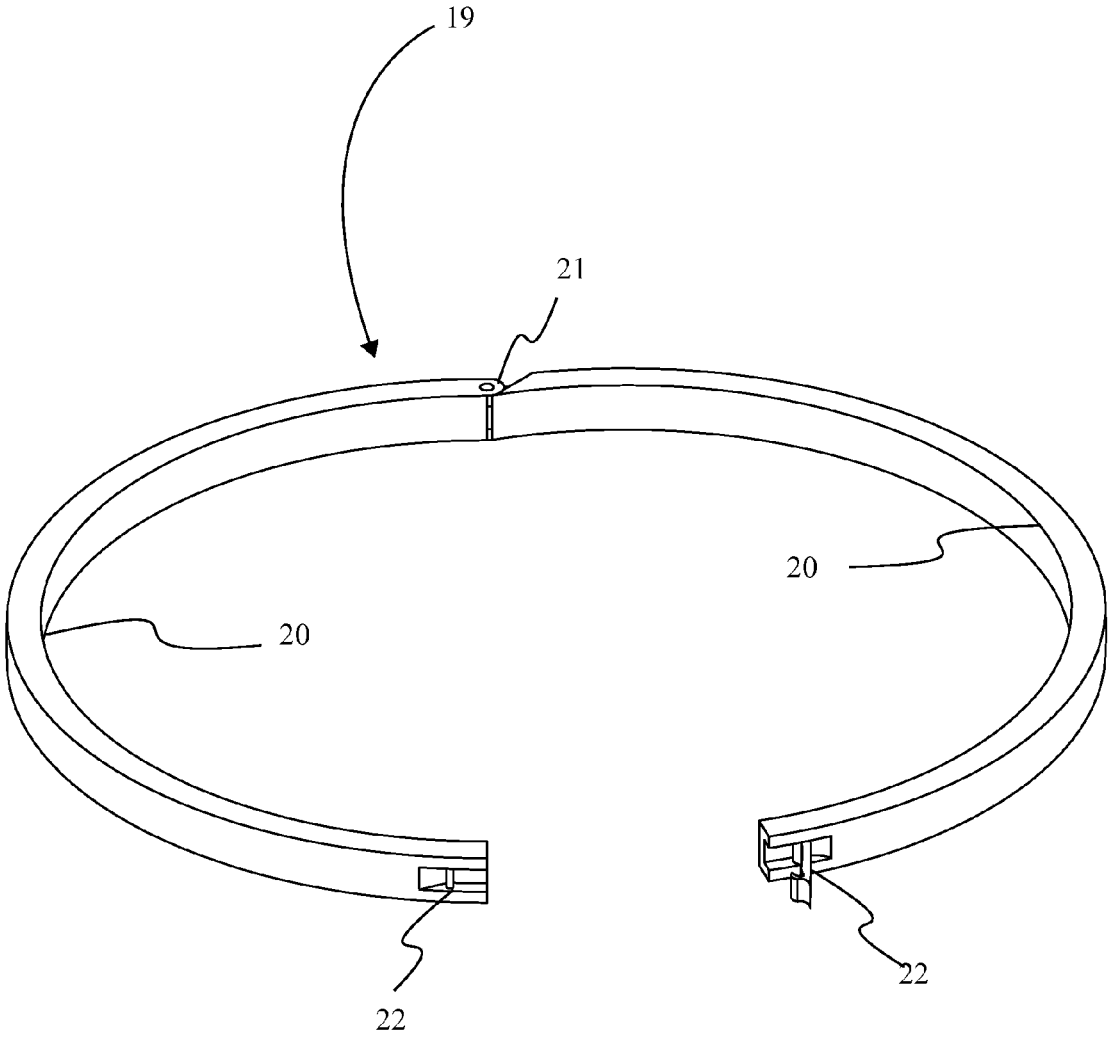
FIG. 4 is an enhanced view of the detachable weights displaying the sub component distribution as per the current embodiment of the present invention.

Referencing FIG. 1 and FIG. 4, the detachable weight 19 is provided as a means to slightly adjust the weight of a particular weight assembly 9. The detachable weight 19 is found positioned concentrically to the weight assembly 9. The concentric positioning of the detachable weight 19 aligns them with the recessed track 18. The detachable weight 19 is positioned coincident with recessed track 18. In the current embodiment of the present invention, the detachable weight 19 comprises at least two arcuately shaped weights 20, at least one hinge 21, and a latching mechanism 22. The at least two arcuately shaped weights 20 are thin semicircular arcs co-radially positioned with the recessed track 18. The co-radial positioning between the at least two arcuately shaped weights 20 and the recessed track 18, allows the at least two arcuately shaped weights 20 to be flush with the padded exterior 12 when coupled into the recessed track 18. The at least two arcuately shaped weights 20 are able to be detachably engaged within the recessed track 18 through the coupling between the at least one hinge 21 and the latching mechanism 22. The at least one hinge 21 is provided as a pivotal means of coupling the at least two arcuately shaped weights 20. The latching mechanism 22 is provided as the means to secure the at least two arcuately shaped weights 20 within the recessed track 18. The latching mechanism 22 is able to couple the at least two arcuately shaped weights 20 to the recessed track 18 depending on the user desired level of resistance.

Referencing FIG. 5, the weight assembly 9 and the elongated handle 1 are provided with a detachable coupling through the engagement of the assembly coupler 6 and the handle shaft 13. The assembly coupler 6 is found sleeved by the handle shaft 13. In the current embodiment of the present invention the assembly coupler 6 comprises a first mechanism engagement 7 and the handle shaft 13 comprises a second locking engagement mechanism. Both the first mechanism engagement 7 and the second mechanism engagement 14 are provided as complimentary components utilized to secure the elongated handle 1 to the weight assembly 9. The first mechanism engagement 7 is found secured to the second mechanism engagement 14. In the current embodiment of the present invention the first mechanism engagement 7 and the second mechanism engagement 14 are provided as part of a locking mechanism for the present invention. The locking mechanism serves as a secure means to detachably engage the elongated handle 1 to the weight assembly 9.

While the present invention is described with a non specific component distributions, two embodiments are provided that describe the specific component interactions for the locking mechanism. The first embodiment is provided with the first mechanism engagement 7 detachably engaged to the second mechanism engagement 14. In the first embodiment of the present invention, the first mechanism engagement 7 comprises at least one elastically driven locking pin 8 and the second mechanism engagement 14 comprises at least one locking pin mount 15. The at least one elastically driven locking pin 8 is a reversible secure engagement that is driven by an elastic component such as a spring. The at least one locking pin mount 15 the complementary engagement point for the at least one elastically driven locking pin 8. The at least one elastically driven locking pin 8 is aligned with the at least one locking pin mount 15, resulting in the at least one elastically driven locking pin 8 being securely and reversibly retained with the at least one locking pin mount 15. The alignment of the elastically driven locking pin 8 with the locking pin mount 15 enables the secure engagement between the elongated handle 1 and the weight assembly 9. The second embodiment is provided with the second mechanism engagement 14 detachably engaged to the first mechanism engagement 7. In the second embodiment of the present invention, the second mechanism engagement 14 comprises at least one elastically driven locking pin 8 and the first mechanism engagement 7 comprises at least one locking pin mount 15. The at least one elastically driven locking pin 8 is a reversible secure engagement that is driven by an elastic component such as a spring. The at least one locking pin mount 15 the complementary engagement point for the at least one elastically driven locking pin 8. The at least one elastically driven locking pin 8 is aligned with the at least one locking pin mount 15, resulting in the at least one elastically driven locking pin 8 being securely and reversibly retained to the at least one locking pin mount 15. The alignment of the at least one elastically driven locking pin 8 with the at least one locking pin mount 15 enables the secure engagement between the elongated handle 1 and the weight assembly 9. It should be noted that the at least one elastically driven locking pin 8 is provided as being either on the first mechanism engagement 7 or the second mechanism engagement 14. This distinction is made to account for component distributions where an array of retractable pins are positioned on either the weight assembly 9 or the elongated handle 1.

While both the first embodiment and the second embodiment of the present invention are provide with an analogous component distribution neither embodiment explicitly describes the means to disengage the first mechanism engagement 7 to from the second mechanism engagement 14. Although the detachment process is not explicitly described it should be understood that the presence of a reversible locking mechanism allows for a plurality of detachment options between the first mechanism engagement 7 and the second mechanism engagement 14. The plurality of detachment options may comprise the user activating a conveniently positioned release button on the elongated handle 1 or the weight assembly 9. furthermore with the distinction of having the mechanical engagement present on either the first mechanism engagement 7 or the second mechanism engagement 14, as per the first and second embodiments, the positioning of a release mechanism could be understood as relative to the positioning of the at least one elastically driven locking pin 8.

In the current embodiment of the present invention the user would be provided with the elongated handle 1 and the weight assembly 9 in a detached state. The user would engage the cylindrical body 2 of the elongated handle 1 at the gripping surface 3 positioning the assembly coupler 6 distal to their hand. At which point the user would have the option to secure the tethered strap 5 to their wrist or their forearm. The user would bring the elongated handle 1 into a collinear alignment with the weight assembly 9. The weight assembly 9 would be provided positioned on the ground with the shaped base 16 coincident with the floor's surface. The coincident positioning provides the weight assembly 9 with a perpendicular orientation for the handle shaft 13 and the shaped base 16. The use would align the elongated handle 1 towards the weight assembly 9 positioning the assembly coupler 6 adjacent to the handle shaft 13. The user would insert the elongated handle 1 into the weight assembly 9 sleeving the assembly coupler 6 with the handle shaft 13. The first mechanism engagement 7 would detachably couple to the second mechanism engagement 14. The secure engagement would allow the user to lift the elongated handle 1 lifting the weight assembly 9 off of the floor's surface to perform a plurality of exercises. If the user wishes to change the resistance in their workout, the user would detach the elongated handle 1 from the weight assembly 9 and reattach the elongated handle 1 to another weight assembly 9 with a higher or lower weight value. The user additionally has the option to slightly increase or decreases the weight of the weight assembly 9 through the use of the detachable weight 19. The detachable weight 19 would be provided detached from the weight assembly 9 the user would be able to reposition the at least two arcuately shaped weights 20 around the recessed weight assembly 9 through the use of the at least one hinge 21 and the latching mechanism 22. The user would position the at least two arcuately shaped weights 20 within the recessed track 18 creating a co-radial alignment between the two components. The user would then couple the at least two arcuately shaped weights 20 to the recessed track 18 through the use of the latching mechanism 22.

In the current embodiment of the present invention, the elongated handle 1 is provided as a rod shaped component due to its cylindrical body 2. While the current embodiment has the elongated handle 1 described generally as a cylindrically shaped structure it should be noted that additional embodiment could potentially incorporate formed structures that are not cylindrical in nature. The elongated handle 1 may use different shapes or geometry for the handle, such as, but not limited to, a square cross section or a curved handle. These formed structures for the elongated handle 1 would allows for the incorporation of a plurality of shaped handles that are able to accommodate the placement of the gripping surface 3, the assembly coupler 6, and the tethered strap 5. These shaped handles can be more ergonomic as well as particularly shaped to allow variations in a workout. The elongated handle 1 is constructed of aluminum or stainless steel. The gripping surface 3 is covered with a gritty material like fine sandpaper in order for the user to ensure a firm grip on the handle. Furthermore, while the elongated handle 1 is provided as a component of the volumetric weight system it should be understood that the elongated handle 1 could potentially be used with other modular system to provide a variety of exercise routine not explicitly described by the present invention. In the current embodiment of the present invention, the weight assembly 9 is spherical in shape. While the current embodiment of the present invention provides the weight assembly 9 as being spherical in shape, additional embodiments can have the weight assembly 9 configured in a plurality of geometric shapes. The weighted body 11 of the spherical body 10 is either made of or filled with a heavy material such as, but not limited to, cement or metal.

In the current embodiment of the present invention, the engagement between the first mechanism engagement 7 and the second mechanism engagement 14 can be accomplished through a plurality of known detachable engagement. the known detachable engagement that could potentially be used by the present invention include but are not limited to a twist lock engagement, a lever lock engagement, a spring lock engagement, a slam latch engagement, or a socket lock engagement. While the current embodiment of the present invention, utilizes a spring lock engagement, additional embodiments a rotational motion to lock the shaft into the weight. The assembly coupler 6 is inserted into the weight assembly 9 comprises a concentric protruding disk with a hole through the protrusion so that the axis of the hole is parallel to the axis of the elongated handle 1. The pin to be inserted into the hole on the protruding disk is oriented vertically and is connected to a shaft passing vertically through the weight assembly 9 and protruding slightly from the surface of the exterior padding, with an activator or other feature on the protruding end allowing the user to pull up on the pin in order to attach or release the handle from the weight. A downward force is applied to the pin by a spring so that the default position of the pin is in the down or locked position. The user pulls on the pin, inserts the elongated handle 1, releases the pin and rotates the elongated handle 1 until the pin falls into the hole. In another embodiment, a similar pin mechanism may be incorporated with a different orientation, such as, but not limited to, a horizontal pin passing through the body of the weight. In another embodiment of the invention, the locking mechanism is constructed so that the elongated handle 1 is released by pushing a button.

In the preferred embodiment of the invention, the bottom of the weight assembly 9 opposite the handle shaft 13 comprises a plurality of thread opening recessed into the padded exterior 12 in order to accept threaded fasteners for mounting the shaped base 16 or another accessory to the bottom of the weight assembly 9. The shaped base 16 is provided with a strap handle 17 wherein the strap handle 17 is a strip of fabric or other material and comprise two strips of Velcro that affix to each other to form the strap handle 17. The shaped base 16 is constructed of a material such as, but not limited to rubber. The shaped base 16 is dimensioned so that the bottom of the shaped base 16 is flat so that when the weight assembly 9 is placed on a floor or the ground it does not roll away. The shaped base 16 is also useful for performing certain exercises.

Figure 6:
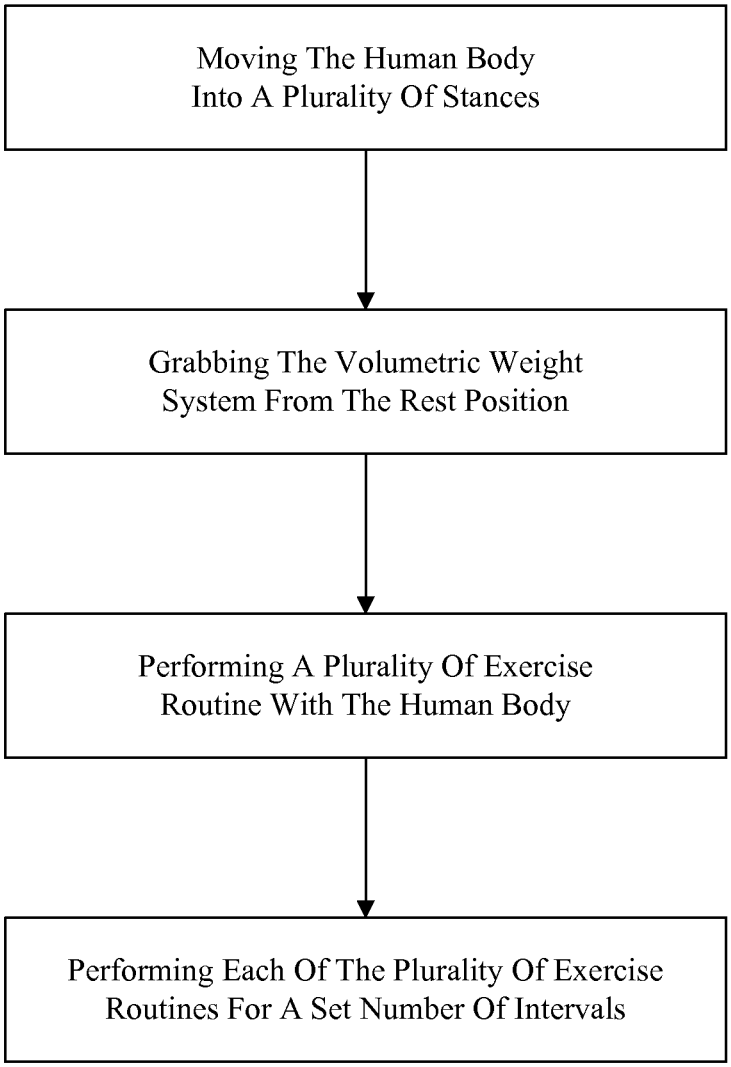
FIG. 6 is a flow chart displaying the common steps involved in the exercise routines as per the current embodiment of the present invention.

In the current embodiment of the present invention, the method for utilizing the volumetric weight system comprises several steps specific to individual exercises. Each of the exercises is provided with common steps. Referencing FIG. 6, the common steps found in each exercise include moving the human body in a plurality of stances, grabbing the volumetric weight system from the rest position, performing a plurality of exercise routine with the human body, and performing each of the plurality of exercise routines for a set number of intervals. The plurality of stances comprises an upright hands in front stance, a feet apart stance, a foot forward stance, and a head down stance. The upright hands in front stance consists of the waist, the torso, and the head being aligned perpendicularly to the floor's surface, while the first arm and the second arm are pivotally positioned to the first shoulder and the second shoulder, respectively, resulting in the first hand and the second hand being parallel to the floor's surface. the feet apart stance consists of the waist, the torso, and the head aligned perpendicular to the floor's surface, while the first leg is angled away from the second leg about the first hip and the second leg is angled away from the first leg about the second hip, wherein a vector formed by the first leg and a vector formed by the floor's surface intersect to create an angular measurement that is equal to the angular. The foot forward stance consists of the second leg, the waist, the torso, and the head being positioned perpendicular to the floor's surface, while the first leg is angled forward about the first hip positioning the first foot in front. The head down stance consists of the first leg, the second leg, the waist, and the torso are positioned perpendicular to the floor's surface, while the head is angled forward. The exercises routines comprise the around the world exercise, the leg raise exercise, the chin swing exercise, the ticking clock exercise, the straight explosion punches exercise, the explosion swings exercise, and the toe raise exercise.

Figure 7:
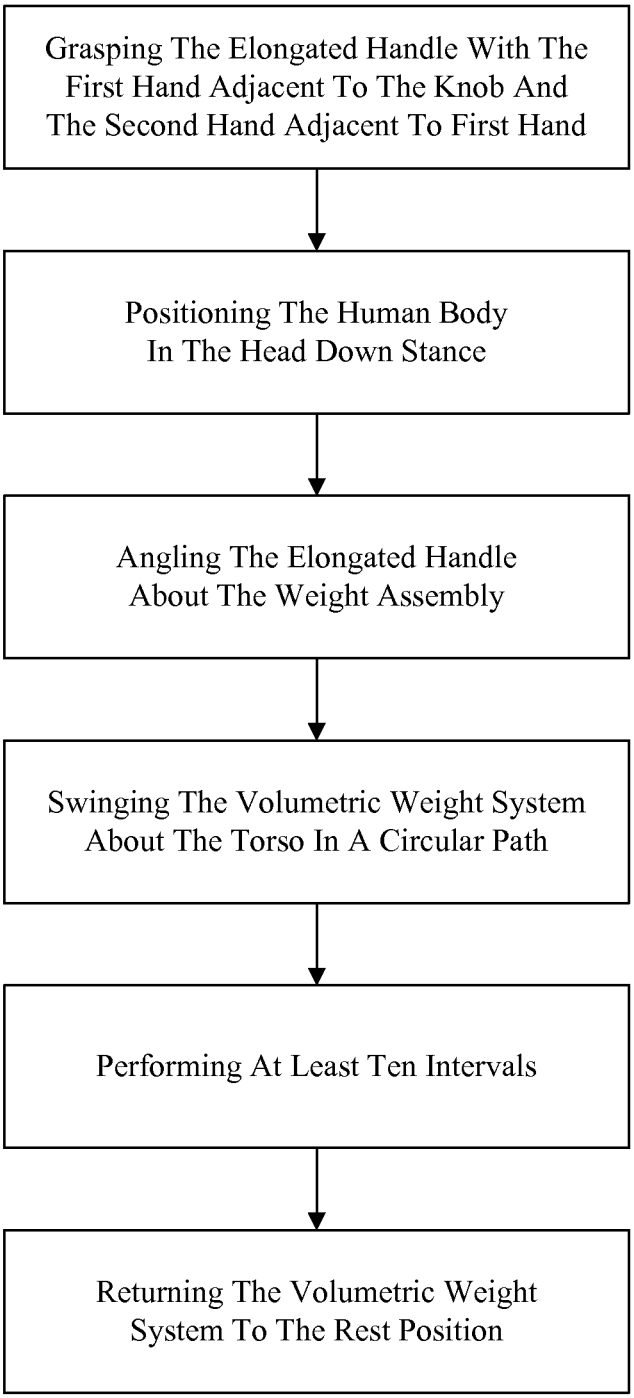
FIG. 7 is a flow chart displaying the steps involved in performing the around the world exercise routine as per the current embodiment of the present invention.

Around the world: the exercise requires holding the elongated handle 1 similar to a golf club and swinging it like a golf club except we are going all the way around to make a full circle. This exercise is provided 10 rotations in one way and 10 in the other. Referencing FIG. 7, the exercise comprises the steps of grasping the elongated handle 1 with the first hand adjacent to the knob 4 and the second hand adjacent to first hand; positioning the human body in the head down stance, wherein the head down stance consists of the first leg, the second leg, the waist, and the torso are positioned perpendicular to the floor's surface, while the head is angled forward; angling the elongated handle 1 about the weight assembly 9, wherein the first arm and the second arm are pivoted towards the elongated handle 1 about the first shoulder and the second shoulder; swinging the volumetric weight system about the torso in a circular path, wherein the circular path is provided with an axial tilt relative to the floor's surface and where one rotation about the circular path comprises an interval; performing at least ten intervals; and returning the volumetric weight system to the rest position. At which point the user would alternate the positioning and their grip to exercise their other side, as well as reverse the direction of the path taken by the volumetric weight system.

Figure 8:
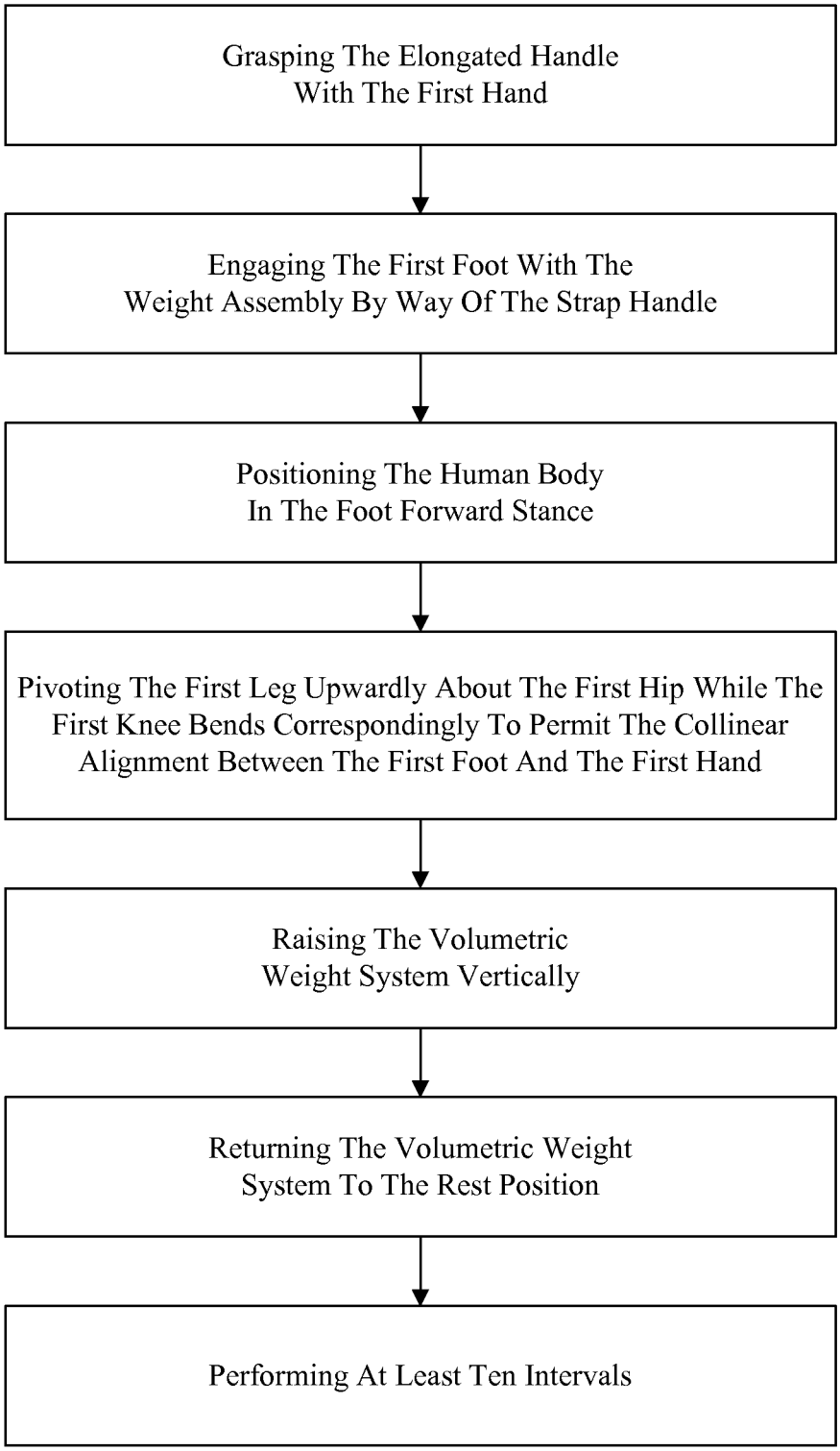
FIG. 8 is a flow chart displaying the steps involved in performing the leg raise exercise routine as per the current embodiment of the present invention.
Figure 9:
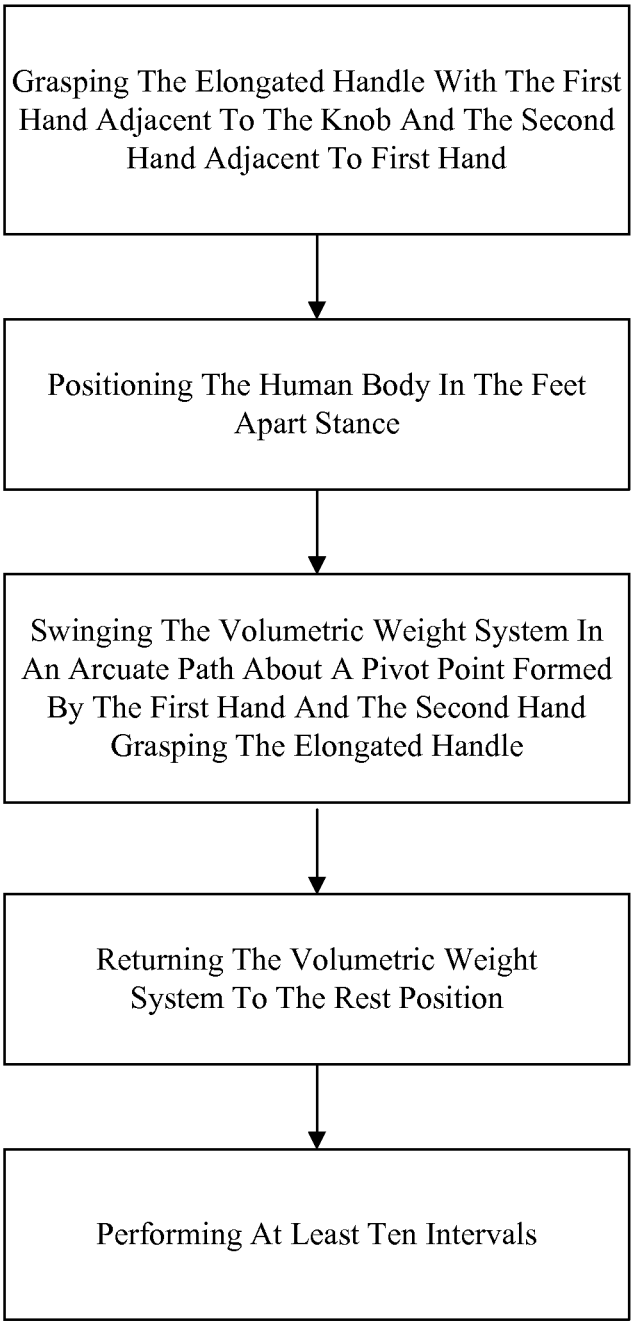
FIG. 9 is a flow chart displaying the steps involved in performing the chin swing exercise routine as per the current embodiment of the present invention.

Leg Raises: this exercise requires the user to engage the volumetric weight system with the strap handle 17. The user would position their foot within the strap handle 17. The user would raise their knee up as high as possible then lower it back down. The user would perform this exercise several times and then switch to the other leg. Referencing FIG. 8, the exercise comprises the steps of grasping the elongated handle 1 with the first hand; engaging the first foot with the weight assembly 9 by way of the strap handle 17, wherein the first foot and first hand form a collinear alignment that is perpendicular to the floor's surface; positioning the human body in the foot forward stance, wherein the foot forwards stance consists of the second leg, the waist, the torso, and the head being positioned perpendicular to the floor's surface, while the first leg is angled forward about the first hip positioning the first foot in front; pivoting the first leg upwardly about the first hip while the first knee bends correspondingly to permit the collinear alignment between the first foot and the first hand; raising the volumetric weight system vertically, wherein the volumetric weight is raised to a desired height; returning the volumetric weight to the rest position, wherein the raising the volumetric weight system and returning the volumetric weight to the rest position is considered an interval; and performing at least ten intervals. At which point the user would alternate the positioning and their grip to exercise their other side, Chin Swings: the exercise requires the user to grab the distal portion of the elongated handle 1 and to swing the volumetric weight system between the user's legs and then up towards the ceiling. In doing so, the user should have the distal end of the elongated handle 1 to almost come in contact with their chin. Referencing FIG. 9, the exercise comprises the steps of grasping the elongated handle 1 with the first hand adjacent to the knob 4 and the second hand adjacent to first hand; positioning the human body in the feet apart stance, wherein the feet apart stance consists of the waist, the torso, and the head aligned perpendicular to the floor's surface, while the first leg is angled away from the second leg about the first hip and the second leg is angled away from the first leg about the second hip, wherein a vector formed by the first leg and a vector formed by the floor's surface intersect to create an angular measurement that is equal to the angular measurement of the vector formed by the second leg and the vector formed by the floor's surface; swinging the volumetric weight system in an arcuate path about a pivot point formed by the first hand and the second hand grasping the elongated handle 1, wherein the volumetric weight system traverse through the arcuate path forming a perpendicular alignment with the floor's surface to forming a parallel alignment with the floor's surface; returning the volumetric weight system to the rest position, wherein the swinging of the volumetric weight along the arcuate path and back to the rest position is considered an interval; and performing at least ten intervals. At which point the user would alternate the positioning and their grip to exercise their other side.

Figure 10:
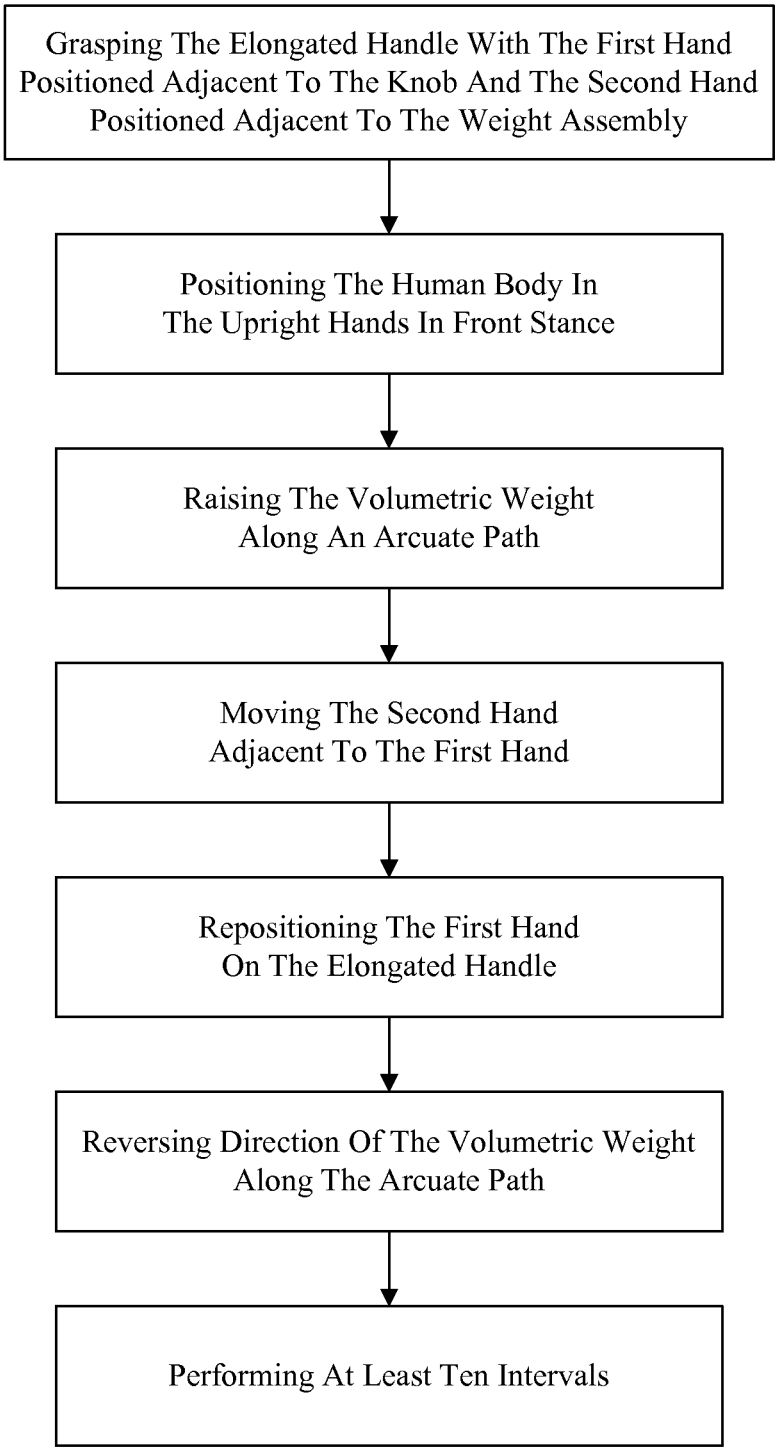
FIG. 10 is a flow chart displaying the steps involved in performing the ticking clock exercise routine as per the current embodiment of the present invention.

Ticking clock: the exercise requires the user to hold the elongated handle 1 with one hand close to the weight assembly 9 and their other hand closer to the distal end. The user would then throw the weight assembly 9 up so both hands would be able to grab the elongated handle 1 closest to the weight assembly 9. After which the user would then switch hands, repositioning their hands to the alternate position where the hand positioned on the distal end would be positioned proximal to the weight assembly 9. The user would continue this process in several directional paths such as back and forth, left and right. Referencing FIG. 10, the exercise comprises the steps of grasping the elongated handle 1 with the first hand positioned adjacent to the knob 4 and the second hand positioned adjacent to the weight assembly 9; positioning the human body in the upright hands in front stance, wherein the upright hands in front stance consists of the waist, the torso, and the head aligned perpendicularly to the floor's surface, while the first arm and the second arm are pivotally positioned to the first shoulder and the second shoulder, respectively, resulting in the first hand and the second hand being parallel to the floor's surface; raising the volumetric weight along an arcuate path, wherein the arcuate path is an inverted parabola with a horizontal corresponding to the parallel positioning of the first hand and the second hand relative to the floor's surface, and where the second hand raises the volumetric weight into the parabolic path about a pivot point formed by the first hand; moving the second hand adjacent to the first hand, wherein the second hand is repositioned adjacent to the first hand on the elongated handle 1 when the elongated handle 1 forms a perpendicular alignment with the floor's surface, while the volumetric weight system moves along the arcuate path; repositioning the first hand on the elongated handle 1, wherein the first hand is moved along the elongated handle 1 until being adjacent to the weight assembly 9, while the volumetric weight system moves along the arcuate path; reversing direction of the volumetric weight along the arcuate path, wherein the reverse direction would incorporate the steps of raising the volumetric weight along the arcuate path, moving the first hand adjacent to the second hand, and repositioning the second hand on the elongated handle 1, where the completion of reversing direction is considered two intervals; and performing at least twenty intervals. At which point the user would alternate the positioning and their grip to exercise their other side.

Figure 11:
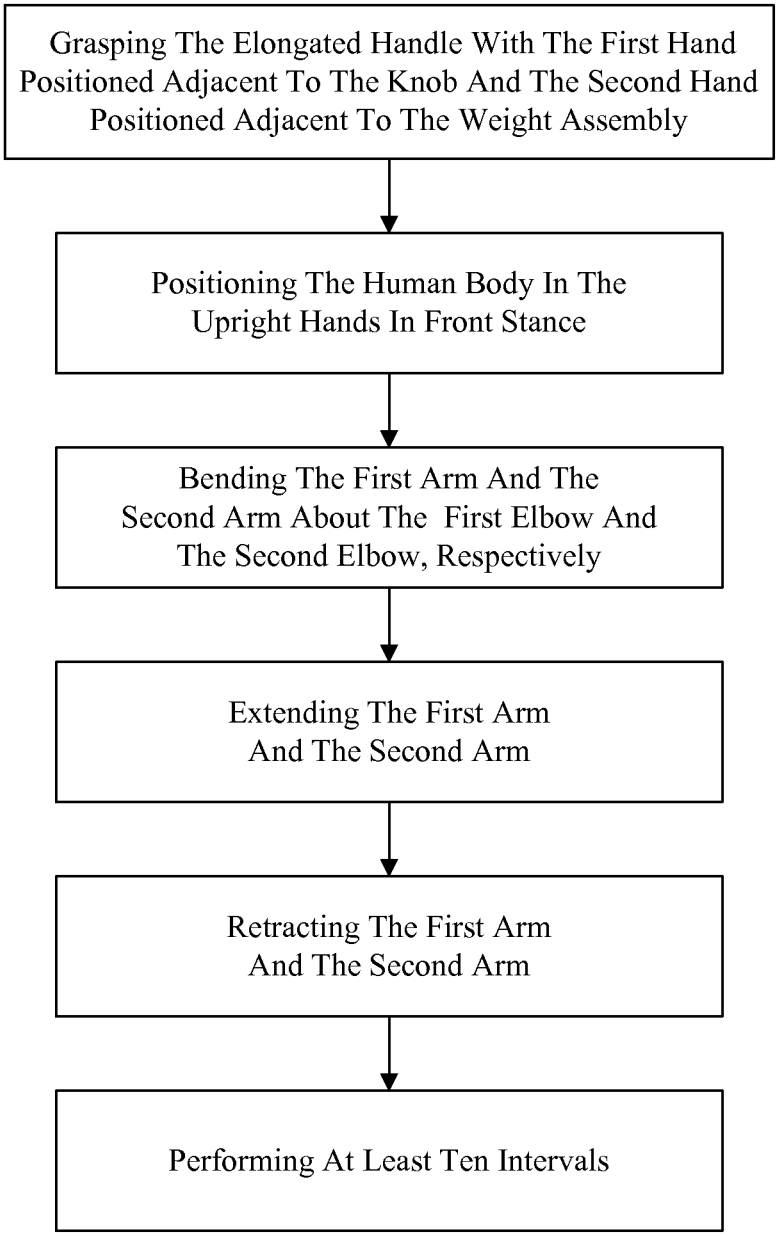
FIG. 11 is a flow chart displaying the steps involved in performing the straight explosion punches exercise routine as per the current embodiment of the present invention.

Straight explosion punches: this exercise requires the user to have their feet open but even. The user would be holding the elongated handle 1 in a similar fashion to the way one would hold a hockey stick, wherein one hand would be positioned up on the elongated handle 1 and the other hand would be positioned down on the elongated handle 1. The user would then straight punch straight out for about 10 repetitions. This motion is most similar to the motion a person would do in hockey when they are checking someone. After which the user would then switch positioning and repeat the action for another 10 repetitions. Referencing FIG. 11, the exercise comprises the steps of grasping the elongated handle 1 with the first hand positioned adjacent to the knob 4 and the second hand positioned adjacent to the weight assembly 9, wherein the first hand grasps the elongated handle 1 with the first palm face oriented in a first direction and the second hand grasps the elongated handle 1 with the second palm face oriented opposite the first direction; positioning the human body in the upright hands in front stance, wherein the upright hands in front stance consists of the waist, the torso, and the head aligned perpendicularly to the floor's surface, while the first arm and the second arm are pivotally positioned to the first shoulder and the second shoulder, respectively, resulting in the first hand and the second hand being parallel to the floor's surface; bending the first arm and the second arm about the first elbow and the second elbow, respectively, wherein bending about the first elbow and the second elbow maintains a parallel positioning between the first hand and the floor's surface and the second hand and the floor's surface, while additionally positioning the volumetric weight assembly 9 proximal to the torso; extending the first arm and the second arm, wherein the first arm and the second arm are extended moving the volumetric weight assembly 9 away from the torso while maintaining the parallel positioning between the first hand and the second hand with the floor's surface; retracting the first arm and the second arm, wherein the first arm and the second arm are bend about the first elbow and the second elbow while maintaining the parallel positioning between the first hand and the second hand with the floor's surface, where retracting the first arm and the second arm is considered an interval; and performing at least twenty intervals.

Figure 12:
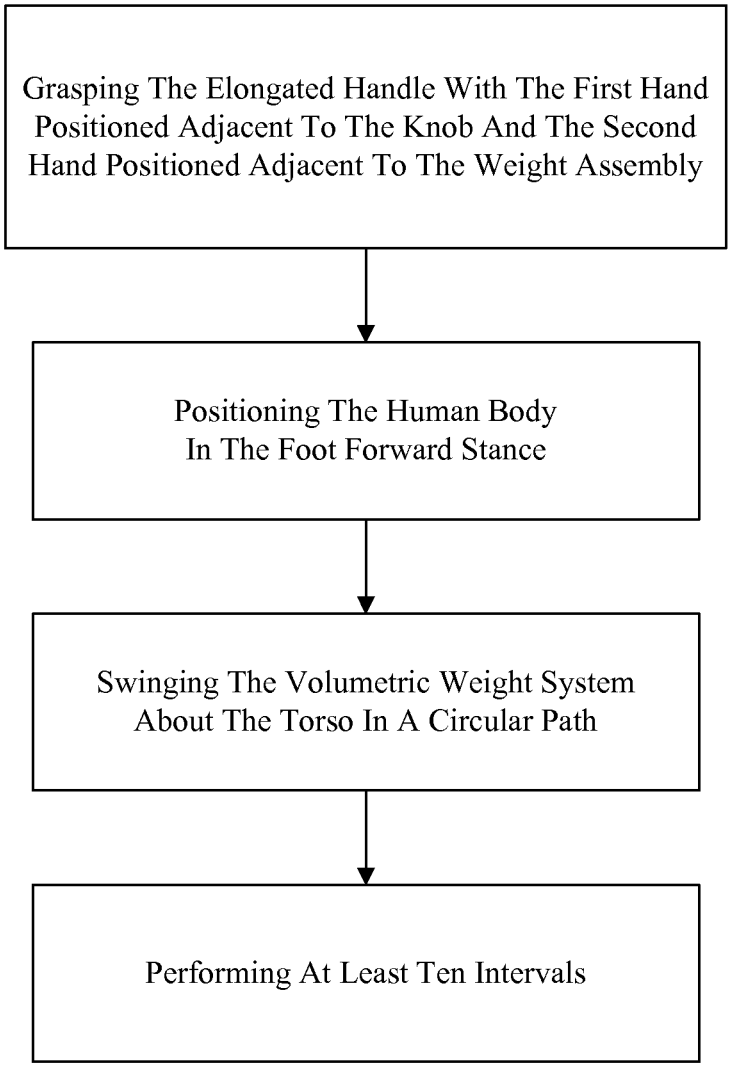
FIG. 12 is a flow chart displaying the steps involved in performing the explosion swings exercise routine as per the current embodiment of the present invention.

Explosion Swings: This exercise requires the user to be positioned in a big stance, with either right foot forward or their left foot forward. The user would hold the elongated handle 1 in the same manner as a hockey stick. The exercise differs in that the user would swing the volumetric weight system similar to a baseball bat. During the rotation process the user's core muscles would stop the rotation; the user would then bring the volumetric weight system back in order to repeat the same action. The user would then switch stance, repositioning their other foot up front and switch direction of the swinging motion. Referencing FIG. 12, the exercise comprises the steps of grasping the elongated handle 1 with the first hand positioned adjacent to the knob 4 and the second hand positioned adjacent to the weight assembly 9; positioning the human body in the foot forward stance, wherein the foot forwards stance consists of the second leg, the waist, the torso, and the head being positioned perpendicular to the floor's surface, while the first leg is angled forward about the first hip positioning the first foot in front; swinging the volumetric weight system about the torso in a circular path, wherein the circular path is provided with an axial tilt relative to the floor's surface and where one rotation about the circular path comprises an interval; and performing at least twenty intervals. At which point the user would alternate the positioning and their grip to exercise their other side.

Figure 13:
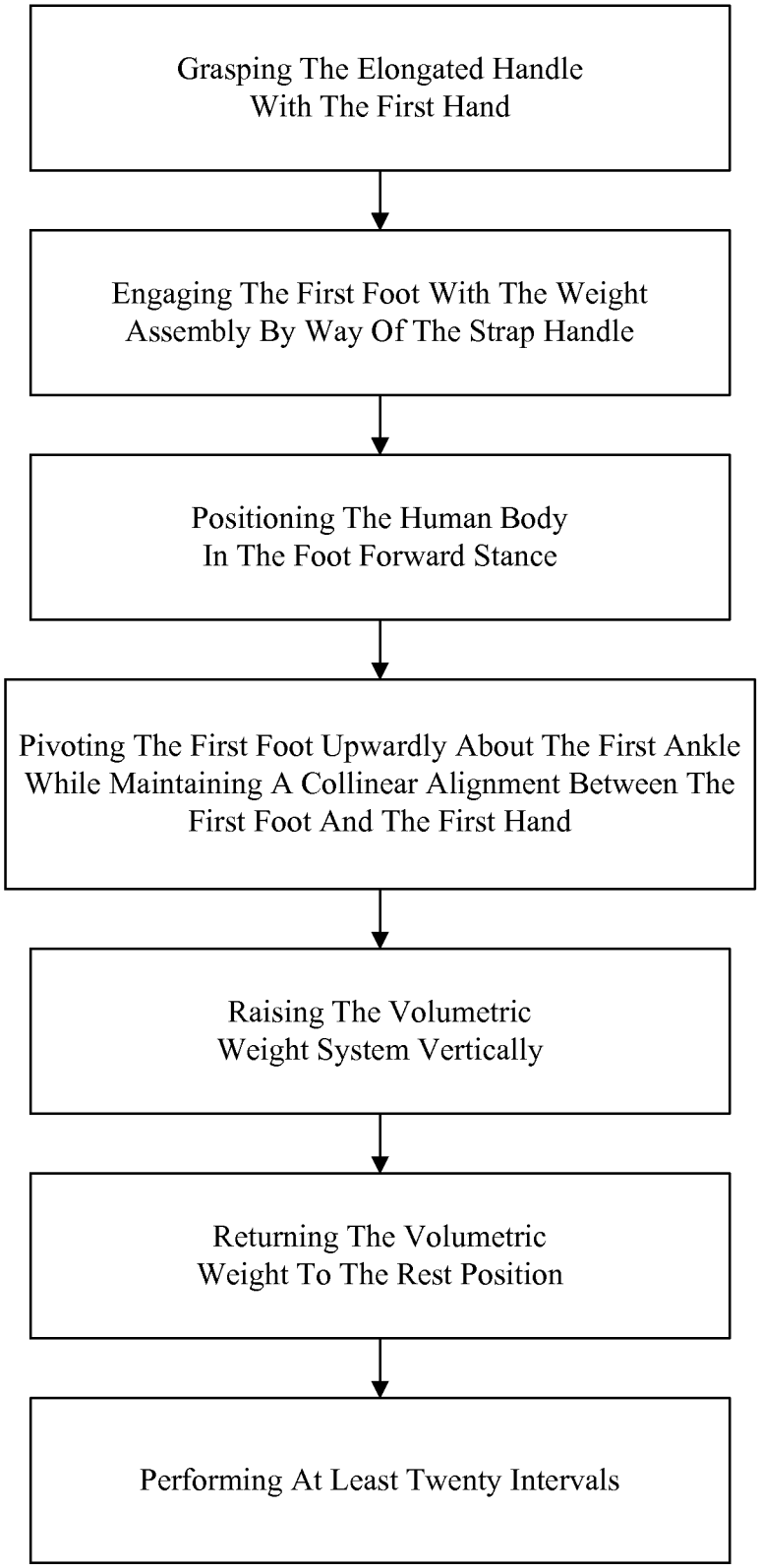
FIG. 13 is a flow chart displaying the steps involved in performing the toe raise exercise routine as per the current embodiment of the present invention.

Toe Raises: this exercise requires the user to engage the volumetric weight system with the strap handle 17. The user would position their foot within the strap handle 17 while holding the elongated handle 1 with their hand. The user would then raise their toes up while stabilizing with the elongated handle 1 if necessary. The exercise is designed to work foot and calf muscle. Referencing FIG. 13, the exercise comprises the steps of grasping the elongated handle 1 with the first hand; engaging the first foot with the weight assembly 9 by way of the strap handle 17, wherein the first foot and first hand form a collinear alignment that is perpendicular to the floor's surface; positioning the human body in the foot forward stance, wherein the foot forwards stance consists of the second leg, the waist, the torso, and the head being positioned perpendicular to the floor's surface, while the first leg is angled forward about the first hip positioning the first foot in front; pivoting the first foot upwardly about the first ankle while maintaining a collinear alignment between the first foot and the first hand, wherein the first leg and the first knee maintain a perpendicular alignment with the floor's surface; raising the volumetric weight system vertically, wherein the volumetric weight is raised to a desired height; returning the volumetric weight to the rest position, wherein the raising the volumetric weight system and returning the volumetric weight to the rest position is considered an interval; and performing at least twenty intervals. At which point the user would alternate the positioning and their grip to exercise their other side.

Although the invention has been explained in relation to its preferred embodiment, it is to be understood that many other possible modifications and variations can be made without departing from the spirit and scope of the invention as hereinafter claimed.

What is claimed is:

1. A volumetric weight system for enhancing fitness comprises:

an elongated handle;

a weight assembly;

the elongated handle comprises a cylindrical body, a gripping surface, a knob, and an assembly coupler;

the weight assembly comprises a spherical body, a handle shaft, and a shaped base;

the assembly coupler comprises a first mechanism engagement; and the spherical body comprises a weighted body and a padded exterior.

2. The volumetric weight system for enhancing fitness as claimed in claim 1 comprises:

the elongated handle being aligned centrally with the detachable weight;

the detachable weight being positioned concentric with the weight assembly; and the elongated handle being positioned normal to the weight assembly.

3. The volumetric weight system for enhancing fitness as claimed in claim 1 comprises:

the gripping surface, the knob, and the assembly coupler being positioned along the cylindrical body;

the gripping surface being positioned between the knob and the assembly coupler;

the handle shaft traversing the spherical body;

the shaped base being coupled to the spherical body opposite the handle shaft;

the handle shaft being surrounded by the weighted body; and the weighted body being perimetrically encased by the padded exterior.

4. The volumetric weight system for enhancing fitness as claimed in claim 3 comprises:

the shaped base comprises a strap handle; and the strap handle being positioned opposite the padded exterior on the shaped base.

5. The volumetric weight system for enhancing fitness as claimed in claim 3 comprises:

the elongated handle comprises a tethered strap; and the tethered strap is coupled to the cylindrical body adjacent to the knob.

6. The volumetric weight system for enhancing fitness as claimed in claim 1 comprises:

the handle shaft comprises a second locking mechanism engagement;

the assembly coupler being sleeved by the handle shaft;

the gripping surface being positioned adjacent to the padded exterior; and the first mechanism engagement being secured to the second mechanism engagement.

7. The volumetric weight system for enhancing fitness as claimed in claim 6 comprises:

the first mechanism engagement being detachably engaged to the second mechanism engagement;

the first mechanism engagement comprises at least one elastically driven locking pin;

the second mechanism engagement comprises at least one locking pin mount; and the at least one elastically driven locking pin being securely and reversibly retained to the at least one locking pin mount.

8. The volumetric weight system for enhancing fitness as claimed in claim 1 comprises:

a detachable weight;

the weight assembly comprises a recessed track;

the detachable weight comprises at least two arcuately shaped weights, at least one hinge, and a latching mechanism;

the detachable weight being coupled to the weight assembly;

the recessed track being positioned concentric to the handle shaft and the spherical body; and the recessed track being circumferentially positioned into the spherical body.

9. The volumetric weight system for enhancing fitness as claimed in claim 7 comprises:

the padded exterior being circumferentially traversed by the recessed track between the handle shaft and the shaped base;

the recessed track being mounted to the weighted body;

the detachable weight being coincident with the recessed track;

the at least two arcuately shaped weights being pivotally coupled to each other by way of the at least one hinge;

the at least two arcuately shaped weights being co-radially positioned with the recessed track; and the at least two arcuately shaped weights being detachably coupled to the recessed track by way of the latching mechanism.

10. A method of using the volumetric weight system for enhancing fitness comprises the steps of:

providing an elongated handle and a weight assembly, wherein the elongated handle comprises a knob and where the weight assembly comprises a shaped base with a strap handle;

providing a human body, wherein the human body comprises a first hand, a second hand, a first wrist, a second wrist, a first arm, a second arm, a first elbow, a second elbow, a first shoulder, a second shoulder, a head, a torso, a waist, a first hip, a second hip, a first knee, a second knee, a first leg, a second leg, a first ankle, a second ankle, a first foot, and a second foot;

providing a rest position, wherein the rest position consists of a perpendicular arrangement between a floor's surface and the volumetric weight system where the weight assembly is positioned on the floors surface with the elongated handle positioned perpendicular to the floor's surface;

moving the human body into a plurality of stances, wherein the plurality of stances comprises an upright hands in front stance, a feet apart stance, a foot forward stance, and a head down stance;

grabbing the volumetric weight system from the rest position;

performing a plurality of exercise routine with the human body, wherein the exercise routines comprises leg raises, chin swings, straight explosion punches, explosion swings, toe raises, around the world exercise, and ticking clock exercise; and performing each of the plurality of exercise routines for a set number of intervals.

11. The method of using the volumetric weight system for enhancing fitness as claimed in claim 10 further comprises the steps of:

grasping the elongated handle with the first hand adjacent to the knob and the second hand adjacent to first hand;

positioning the human body in the head down stance, wherein the head down stance consists of the first leg, the second leg, the waist, and the torso are positioned perpendicular to the floor's surface, while the head is angled forward;

angling the elongated handle about the weight assembly, wherein the first arm and the second arm are pivoted towards the elongated handle about the first shoulder and the second shoulder;

swinging the volumetric weight system about the torso in a circular path, wherein the circular path is provided with an axial tilt relative to the floor's surface and where one rotation about the circular path comprises an interval;

performing at least ten intervals; and returning the volumetric weight system to the rest position.

12. The method of using the volumetric weight system for enhancing fitness as claimed in claim 10 further comprises the steps of:

grasping the elongated handle with the first hand;

engaging the first foot with the weight assembly by way of the strap handle, wherein the first foot and first hand form a collinear alignment that is perpendicular to the floor's surface;

positioning the human body in the foot forward stance, wherein the foot forwards stance consists of the second leg, the waist, the torso, and the head being positioned perpendicular to the floor's surface, while the first leg is angled forward about the first hip positioning the first foot in front;

pivoting the first leg upwardly about the first hip while the first knee bends correspondingly to permit the collinear alignment between the first foot and the first hand;

raising the volumetric weight system vertically, wherein the volumetric weight is raised to a desired height;

returning the volumetric weight to the rest position, wherein the raising the volumetric weight system and returning the volumetric weight to the rest position is considered an interval; and performing at least ten intervals.

13. The method of using the volumetric weight system for enhancing fitness as claimed in claim 10 further comprises the steps of:

grasping the elongated handle with the first hand adjacent to the knob and the second hand adjacent to first hand;

positioning the human body in the feet apart stance, wherein the feet apart stance consists of the waist, the torso, and the head aligned perpendicular to the floor's surface, while the first leg is angled away from the second leg about the first hip and the second leg is angled away from the first leg about the second hip, wherein a vector formed by the first leg and a vector formed by the floor's surface intersect to create an angular measurement that is equal to the angular measurement of the vector formed by the second leg and the vector formed by the floor's surface;

swinging the volumetric weight system in an arcuate path about a pivot point formed by the first hand and the second hand grasping the elongated handle, wherein the volumetric weight system traverse through the arcuate path forming a perpendicular alignment with the floor's surface to forming a parallel alignment with the floor's surface;

returning the volumetric weight system to the rest position, wherein the swinging of the volumetric weight along the arcuate path and back to the rest position is considered an interval; and performing at least ten intervals.

14. The method of using the volumetric weight system for enhancing fitness as claimed in claim 10 further comprises the steps of:

grasping the elongated handle with the first hand positioned adjacent to the knob and the second hand positioned adjacent to the weight assembly;

positioning the human body in the upright hands in front stance, wherein the upright hands in front stance consists of the waist, the torso, and the head aligned perpendicularly to the floor's surface, while the first arm and the second arm are pivotally positioned to the first shoulder and the second shoulder, respectively, resulting in the first hand and the second hand being parallel to the floor's surface;

raising the volumetric weight along an arcuate path, wherein the arcuate path is an inverted parabola with a horizontal corresponding to the parallel positioning of the first hand and the second hand relative to the floor's surface, and where the second hand raises the volumetric weight into the parabolic path about a pivot point formed by the first hand;

moving the second hand adjacent to the first hand, wherein the second hand is repositioned adjacent to the first hand on the elongated handle when the elongated handle forms a perpendicular alignment with the floor's surface, while the volumetric weight system moves along the arcuate path;

repositioning the first hand on the elongated handle, wherein the first hand is moved along the elongated handle until being adjacent to the weight assembly, while the volumetric weight system moves along the arcuate path;

reversing direction of the volumetric weight along the arcuate path, wherein the reverse direction would incorporate the steps of raising the volumetric weight along the arcuate path, moving the first hand adjacent to the second hand, and repositioning the second hand on the elongated handle, where the completion of reversing direction is considered two intervals; and performing at least twenty intervals.

15. The method of using the volumetric weight system for enhancing fitness as claimed in claim 10 further comprises the steps of:

providing a first palm face and a second palm face;

grasping the elongated handle with the first hand positioned adjacent to the knob and the second hand positioned adjacent to the weight assembly, wherein the first hand grasps the elongated handle with the first palm face oriented in a first direction and the second hand grasps the elongated handle with the second palm face oriented opposite the first direction;

positioning the human body in the upright hands in front stance, wherein the upright hands in front stance consists of the waist, the torso, and the head aligned perpendicularly to the floor's surface, while the first arm and the second arm are pivotally positioned to the first shoulder and the second shoulder, respectively, resulting in the first hand and the second hand being parallel to the floor's surface;

bending the first arm and the second arm about the first elbow and the second elbow, respectively, wherein bending about the first elbow and the second elbow maintains a parallel positioning between the first hand and the floor's surface and the second hand and the floor's surface, while additionally positioning the volumetric weight assembly proximal to the torso;

extending the first arm and the second arm, wherein the first arm and the second arm are extended moving the volumetric weight assembly away from the torso while maintaining the parallel positioning between the first hand and the second hand with the floor's surface;

retracting the first arm and the second arm, wherein the first arm and the second arm are bend about the first elbow and the second elbow while maintaining the parallel positioning between the first hand and the second hand with the floor's surface, where retracting the first arm and the second arm is considered an interval; and performing at least twenty intervals.

16. The method of using the volumetric weight system for enhancing fitness as claimed in claim 10 further comprises the steps of:

grasping the elongated handle with the first hand positioned adjacent to the knob and the second hand positioned adjacent to the weight assembly;

positioning the human body in the foot forward stance, wherein the foot forwards stance consists of the second leg, the waist, the torso, and the head being positioned perpendicular to the floor's surface, while the first leg is angled forward about the first hip positioning the first foot in front;

swinging the volumetric weight system about the torso in a circular path, wherein the circular path is provided with an axial tilt relative to the floor's surface and where one rotation about the circular path comprises an interval; and performing at least twenty intervals.

17. The method f using the volumetric weight system for enhancing fitness as claimed in claim 10 further comprises the steps of:

grasping the elongated handle with the first hand;

engaging the first foot with the weight assembly by way of the strap handle, wherein the first foot and first hand form a collinear alignment that is perpendicular to the floor's surface;

positioning the human body in the foot forward stance, wherein the foot forwards stance consists of the second leg, the waist, the torso, and the head being positioned perpendicular to the floor's surface, while the first leg is angled forward about the first hip positioning the first foot in front;

pivoting the first foot upwardly about the first ankle while maintaining a collinear alignment between the first foot and the first hand, wherein the first leg and the first knee maintain a perpendicular alignment with the floor's surface;

raising the volumetric weight system vertically, wherein the volumetric weight is raised to a desired height;

returning the volumetric weight to the rest position, wherein the raising the volumetric weight system and returning the volumetric weight to the rest position is considered an interval; and performing at least twenty intervals.

* * * * *